US012747553B2

(12) United States Patent
Luli et al.

(10) Patent No.: US 12,747,553 B2
(45) Date of Patent: Sep. 29, 2026

(54) CHUTE ROTATION CONTROL SYSTEM FOR SNOW THROWER

(71) Applicant: MTD PRODUCTS INC, Valley City, OH (US)

(72) Inventors: Edmund Carl Luli, Uniontown, OH (US); Michael Wright, Wadsworth, OH (US); Brian Carter, Valley City, OH (US); David Kusnerak, Medina, OH (US)

(73) Assignee: MTD Products Inc, Valley City, OH (US)

( * ) Notice: Subject to any disclaimer, the term of this patent is extended or adjusted under 35 U.S.C. 154(b) by 388 days.

(21) Appl. No.: 18/374,317

(22) Filed: Sep. 28, 2023

(65) Prior Publication Data

US 2024/0110349 A1 Apr. 4, 2024

Related U.S. Application Data

(60) Provisional application No. 63/413,032, filed on Oct. 4, 2022.

(51) Int. Cl.
*E01H 5/04* (2006.01)
*E01H 5/09* (2006.01)

(52) U.S. Cl.
CPC ..... *E01H 5/045* (2013.01); *E01H 5/098* (2013.01)

(58) Field of Classification Search
CPC ..... E01H 5/04; E01H 5/045
See application file for complete search history.

(56) References Cited

U.S. PATENT DOCUMENTS 9,903,079 B2 * 2/2018 Palicki ..... E01H 5/045
10,214,869 B1 2/2019 Krajewski et al.

FOREIGN PATENT DOCUMENTS

EP 2615210 A2 7/2013

OTHER PUBLICATIONS

International Search Report of corresponding International Application No. PCT/US2023/034439 dated Jan. 25, 2024, 8 pages.

* cited by examiner

*Primary Examiner* — Christopher J Sebesta
*Assistant Examiner* — Audrey L Lusk
(74) *Attorney, Agent, or Firm* — Wegman Hessler

(57) ABSTRACT

A chute rotation control system for a snow thrower is disclosed. One example embodiment is a chute rotation control system configured to rotate a chute of a snow thrower, comprising: a chute rotation motor coupled to the chute via one or more gears, wherein the chute rotation motor is configured to alternately rotate the chute clockwise and counterclockwise; a left chute control configured to receive one or more left user inputs and to generate a left output signal; a right chute control configured to receive one or more right user inputs and to generate a right output signal; and a motor controller configured to receive the left input signal and the right input signal, to cause the chute rotation motor to rotate the chute counterclockwise in response to the left input, and to cause the chute rotation motor to rotate the chute clockwise in response to the right input signal.

12 Claims, 8 Drawing Sheets

EXAMPLE SNOW THROWER
100

CHUTE ROTATION CONTROL SYSTEM FOR SNOW THROWER

CROSS-REFERENCE TO RELATED APPLICATIONS

This application claims the benefit of U.S. Provisional Application No. 63/413,032 filed Oct. 4, 2022, which is hereby incorporated by reference within the presented disclosure in its entirety and for all purposes. U.S. Pat. No. 10,087,592 issued Oct. 2, 2018 is hereby incorporated herein by reference in its entirety and for all purposes.

FIELD OF DISCLOSURE

This application relates generally to snow throwing power equipment, and more specifically to a control system for rotating an output chute of a snow thrower.

BACKGROUND

The output chute of a snow thrower directs the thrown snow in the correct direction for clearing an area. Existing designs manually rotate the chute via a cable-driven lever connected to a chute gear ring, or by manually rotating an auger screw to drive a ring gear. This requires an operator to remove a hand from the control surfaces of the snow thrower to operate the chute rotate mechanism.

SUMMARY

The following presents a simplified summary in order to provide a basic understanding of some example aspects of the disclosure. This summary is not an extensive overview. Moreover, this summary is not intended to identify critical elements of the disclosure nor delineate the scope of the disclosure. The sole purpose of the summary is to present some concepts in simplified form as a prelude to the more detailed description that is presented later.

In various embodiments, the subject disclosure provides a system that facilitates motorized rotation of the chute of a snow thrower based on operator input and/or a snow thrower comprising such a system. One example embodiment of such a system can comprise a pair of paddles, mounted to the control panel of the snow thrower, that can be actuated by the operator with hands in the operating position of the control surfaces. These paddles can direct the actuation of a DC motor, which drives a chute rotate gear (e.g., a ring gear on the chute, etc.) via a gearbox. The chute can rotate left or right until a hard stop is reached. The pivoting paddles on the control panel of the snow thrower can actuate small switches (e.g., one per paddle). Each switch can direct the motor to rotate either clockwise or counterclockwise. The motor can actuate a worm, which transfers the rotation to a worm gear, and the rotation can be further transferred via a gear train to the chute ring gear, which rotates the chute.

According to one aspect, an example chute rotation control system is disclosed. The example chute rotation control system is configured to rotate a chute of a snow thrower, and comprises: a chute rotation motor coupled to the chute via one or more gears, wherein the chute rotation motor is configured to alternately rotate the chute clockwise and counterclockwise; a left chute control configured to receive one or more left user inputs and to generate a left output signal; a right chute control configured to receive one or more right user inputs and to generate a right output signal; and a motor controller configured to receive the left input signal and the right input signal, to cause the chute rotation motor to rotate the chute counterclockwise in response to the left input, and to cause the chute rotation motor to rotate the chute clockwise in response to the right input signal.

According to another aspect, an example snow thrower is disclosed. The example snow thrower comprises: one or more movement elements configured to move the snow thrower on a surface; an auger housing and an auger positioned within the auger housing for moving material within the auger housing toward an output of the auger housing; an impeller housing coupled to the auger housing and having an intake through which the material is received at the impeller housing from the output of the auger housing; an impeller configured to receive the material at the intake of the impeller housing and expel the material from the impeller housing by way of a chute coupled to the impeller housing; a power system comprising an electric motor that generates mechanical power as an output and receives electrical power as an input; and a chute rotation control system configured to rotate the chute, comprising: a chute rotation motor coupled to the chute via one or more gears, wherein the chute rotation motor is configured to alternately rotate the chute clockwise and counterclockwise; a left chute control configured to receive one or more left user inputs and to generate a left output signal; a right chute control configured to receive one or more right user inputs and to generate a right output signal; and a motor controller configured to receive the left input signal and the right input signal, to cause the chute rotation motor to rotate the chute counterclockwise in response to the left input, and to cause the chute rotation motor to rotate the chute clockwise in response to the right input signal.

To accomplish the foregoing and related ends, certain illustrative aspects of the disclosure are described herein in connection with the following description and the drawings. These aspects are indicative, however, of but a few of the various ways in which the principles of the disclosure can be employed and the subject disclosure is intended to include all such aspects and their equivalents. Other advantages and features of the disclosure will become apparent from the following detailed description of the disclosure when considered in conjunction with the drawings.

BRIEF DESCRIPTION OF THE DRAWINGS

The foregoing and other aspects of the present disclosure will become apparent to those skilled in the art to which the present disclosure relates upon reading the following description with reference to the accompanying drawings, in which.

Figure 1:
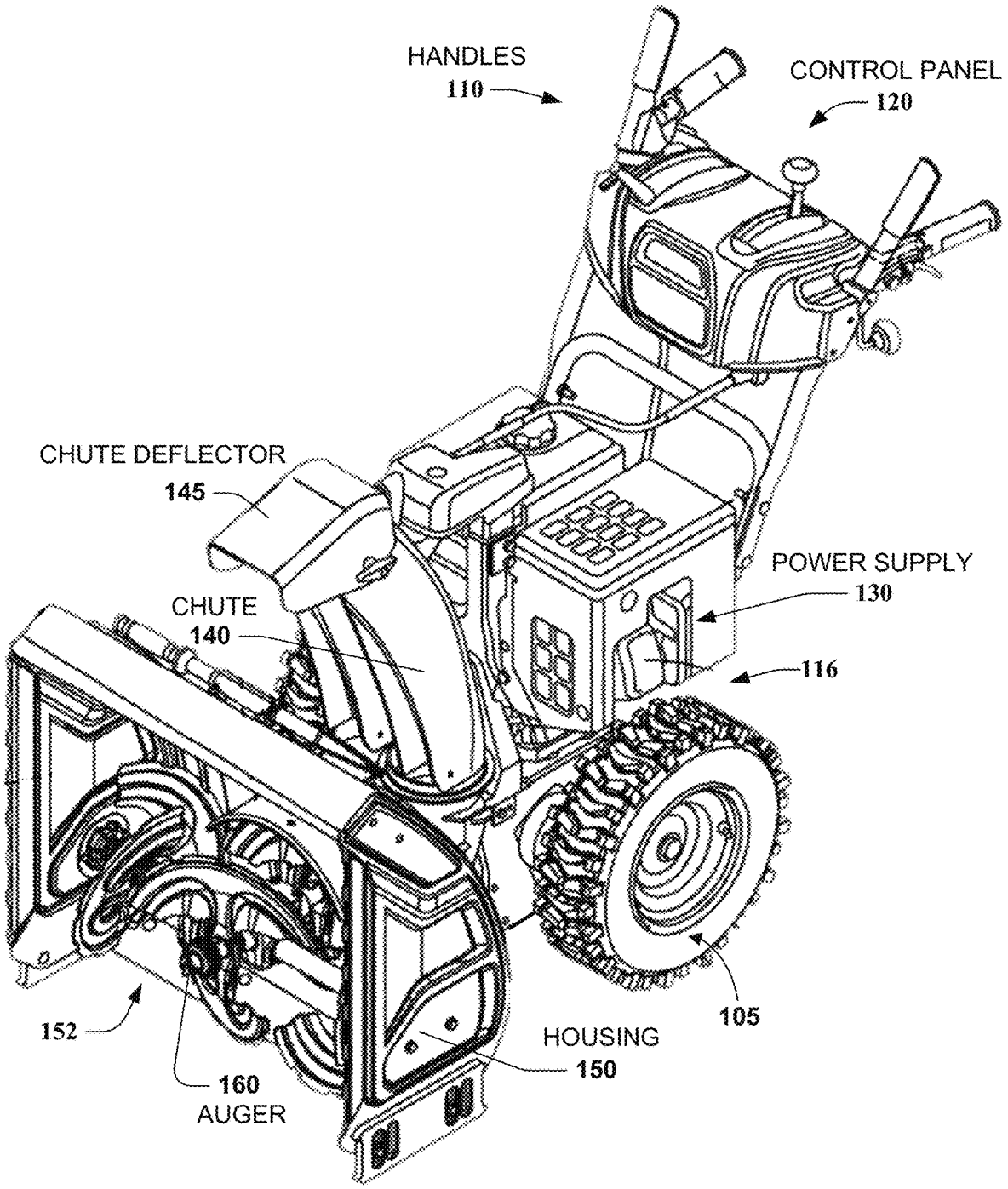
FIG. 1 illustrates a diagram of an example snow thrower apparatus, according to various aspects discussed herein.

It should be noted that the drawings are diagrammatic and not drawn to scale. Relative dimensions and proportions of parts of the figures have been shown exaggerated or reduced in size for the sake of clarity and convenience in the drawings. The same reference numbers are generally used to refer to corresponding or similar features in the different embodiments, except where clear from context that same reference numbers refer to disparate features. Accordingly, the drawings and description are to be regarded as illustrative in nature and not as restrictive.

While embodiments of the disclosure pertaining to providing control system(s) for rotation of a chute of a snow thrower are described herein, it should be understood that the disclosed machines, electronic and computing devices and methods are not so limited and modifications may be made without departing from the scope of the present disclosure. The scope of the systems, methods, and electronic and computing devices for providing control of chute rotation for a snow thrower are defined by the appended claims, and all devices, processes, and methods that come within the meaning of the claims, either literally or by equivalence, are intended to be embraced therein.

DETAILED DESCRIPTION

Example embodiments that incorporate one or more aspects of the present disclosure are described and illustrated in the drawings. These illustrated examples are not intended to be a limitation on the present disclosure. For example, one or more aspects of the present disclosure can be utilized in other embodiments and even other types of devices. Moreover, certain terminology is used herein for convenience only and is not to be taken as a limitation on the present disclosure. Still further, in the drawings, the same reference numerals are employed for designating the same elements.

Referring to FIG. 1, illustrated is an example snow thrower apparatus 100 that can comprise, employ, or be employed as an embodiment according to various aspects discussed herein. Snow thrower apparatus 100 includes a power supply 130 configured to provide power, whether directly or indirectly, to one or more components of snow thrower apparatus 100 to accomplish functions of snow thrower apparatus 100. For instance, power supply 130 can be configured to provide mechanical power to mechanically driven implements, electrical power to electrically driven implements or to electronic devices utilizing the electrical power for data processing, data storage, data display, operator interface functions, or the like, or a suitable combination of the foregoing. As one example, power supply 130 can provide power to drive one or more implement devices—such as auger 160—of snow thrower apparatus 100 to remove snow (or other material) from a surface on which snow thrower apparatus 100 operates. In another example, power supply 130 can drive an impeller of snow thrower apparatus that ejects snow (or other material) from an interior of snow thrower apparatus 100 to an exterior thereof. The impeller is another example of an implement device of snow thrower apparatus 100. In yet another example, power supply 130 can drive movable members 105 (depicted as wheels, but can also include tracks, chains, or similar device) for moving snow thrower apparatus 100 on the surface. In other embodiments (e.g., snow thrower 200 discussed below), movable members can be non-driven, and the snow thrower can be propelled by a user pushing it. Movable members 105 can also be considered among the implement devices of snow thrower apparatus 100, in some disclosed embodiments. In FIG. 1, power supply 130 is shown as an internal combustion engine, but can alternatively be embodied by an electric motor corded to receive electrical power—from a rechargeable battery or a fixed electrical power supply outlet—or a hybrid gas/electric power supply, or other suitable power supply.

Figure 2:
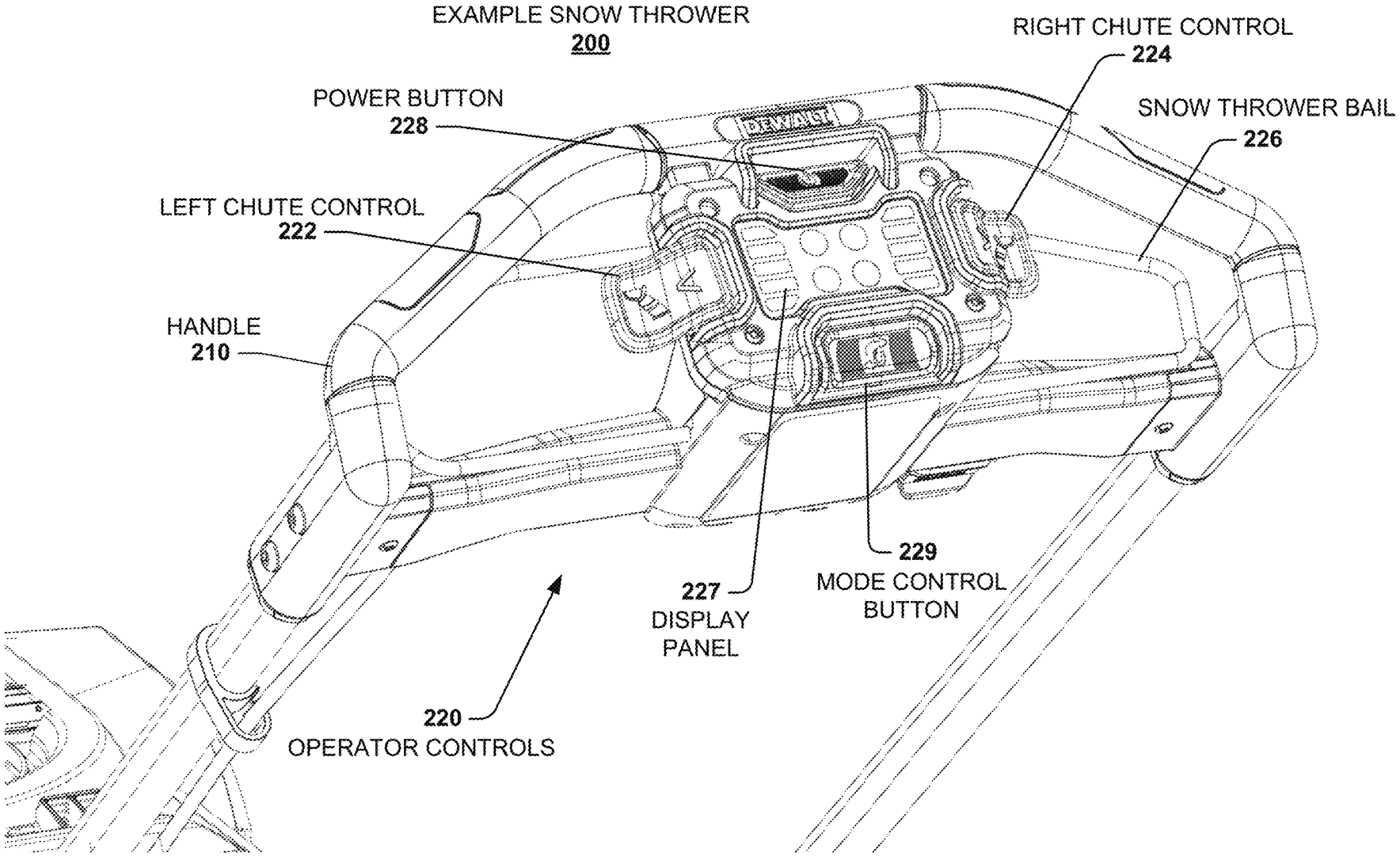
FIG. 2 illustrates a top perspective view of a second example snow thrower showing controls comprising left and right chute controls, according to various aspects discussed herein.
Figure 3:
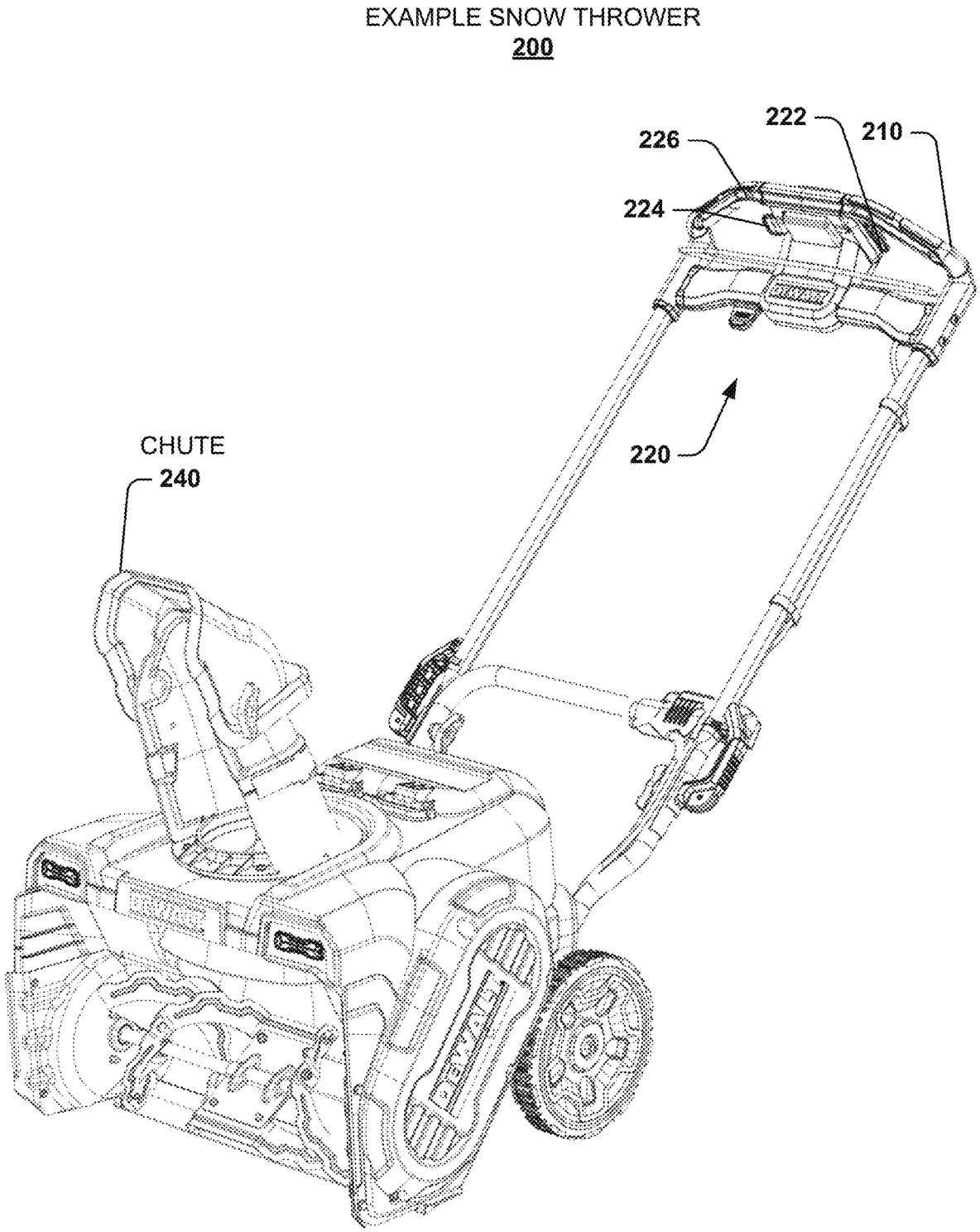
FIG. 3 illustrates a front side perspective view of the second snow thrower showing controls comprising left and right chute controls, according to various aspects discussed herein.
Figure 4:
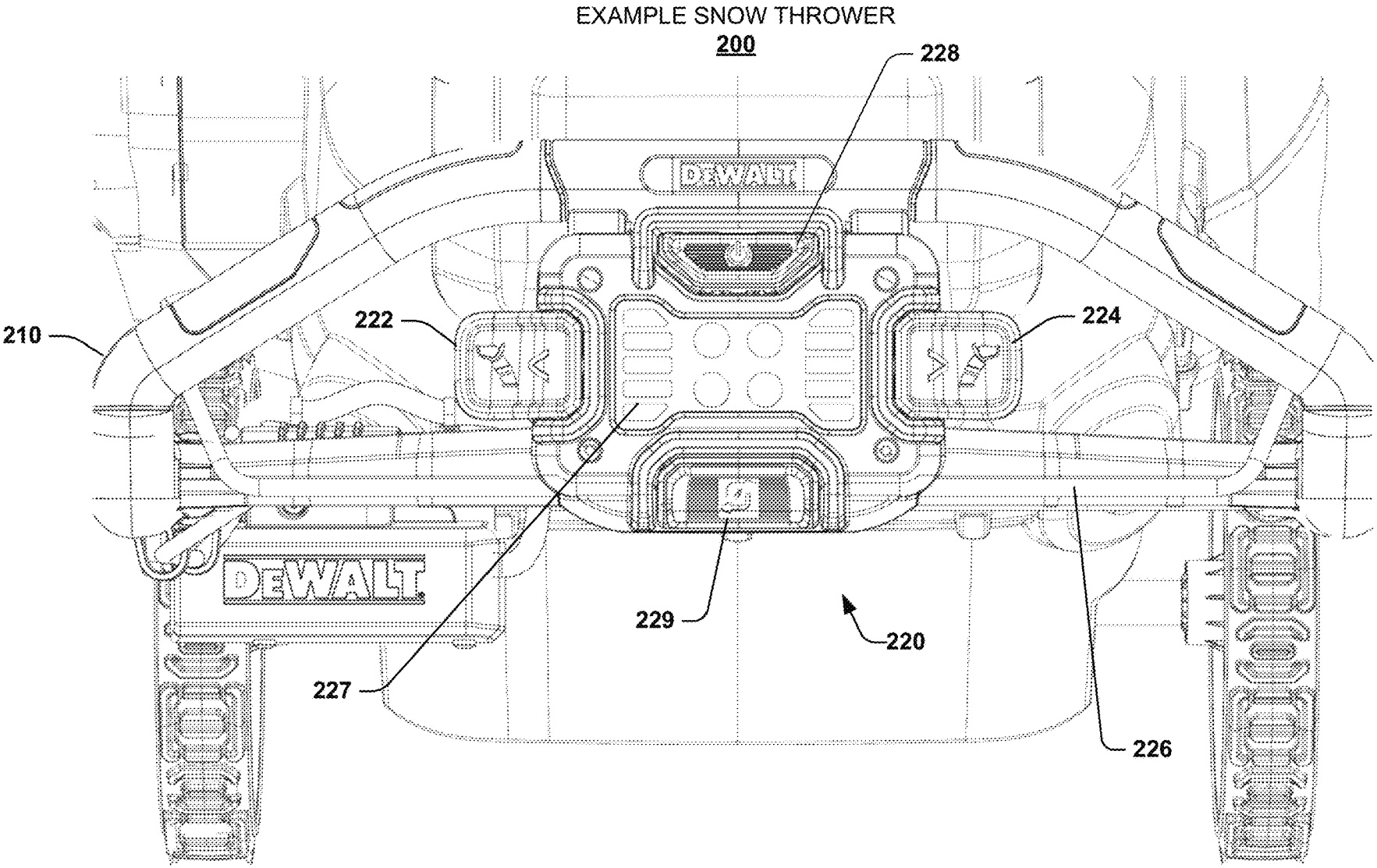
FIG. 4 illustrates a top view of the second example snow thrower showing controls comprising left and right chute controls, according to various aspects discussed herein.

Snow thrower apparatus 100 can include one or more graspable handles 110 extending from a frame 116 (e.g., two separate handles as shown in FIG. 1, or a single handle with multiple gripping locations as shown in FIGS. 2-4, etc.). Handles 110 can be used by an operator to control direction and movement of snow thrower apparatus 100 and can support a control panel 120 having one or more operator controls configured to actuate various implements of snow thrower apparatus 100. For instance, control panel 120 can comprise a drive actuator to cause movable members 105 to move snow thrower apparatus 100 along a surface, a snow removal actuator to activate an auger 160 to intake snow (or other material) from the surface and to activate an impeller (not depicted) to expel the snow (or other material) from snow thrower apparatus 100. Additionally, control panel 120 can comprise one or more actuators to adjust a transmission and drive speed of movable members 105 (if driven), impeller speed of the impeller, auger speed of auger 160, orientation of a chute 140 or angle of chute deflector 145, or the like, or a suitable combination of the foregoing. In various embodiments discussed in more detail below, control panel 110 can comprise one or more controls to control a motor to rotate chute 140 left (e.g., counter-clockwise, etc.) and/or right (e.g., clockwise, etc.).

In more detail, movable members 105, if driven, can be driven by a transmission powered by power supply 130 and secured to frame 116. Snow thrower apparatus 100 can include snow removal implements configured to remove snow (or other material) from a surface on which snow thrower apparatus 100 rests. Removing snow can be accomplished by collecting the snow within an auger housing opening 152 secured to frame 116 in response to movable members 105 moving snow thrower apparatus 100 upon the surface. Snow collected within auger housing opening 152 is moved toward a central and rear portion of auger housing 150 to an output of auger housing 150 in response to actuation (e.g., rotation) of auger 160. An intake portion of an impeller housing is adjacent to and fluidly coupled with the output of auger housing 150. Snow moved to the output of auger housing 150 by auger 160 is acquired by an impeller. In response to actuation of the impeller, the snow acquired by the impeller is ejected from chute 140 in a direction defined by chute 140 and in an orientation defined generally by chute deflector 145.

In the embodiment depicted by FIG. 1, auger housing 150 can be generally semi-cylindrical in cross-section (e.g., viewed from the side), C-shaped, or the like and includes a recess defined by auger housing opening 152 that extends rearwardly through the auger housing 150. In addition, auger housing 150 is laterally oriented with respect to the longitudinal axis and fore/aft movement of snow thrower apparatus 100. Auger housing 150 can be formed of a metal, metal alloy, plastic, metal-plastic composite material, or other suitable material having sufficient strength and structural integrity to maintain its structure within low temperatures (e.g., below 0 degrees Celsius) while supporting mechanically driven auger 160, an auger motor drive and an auger-impeller drive exchange), and withstanding rocks, ice and other material that can enter auger housing 150 and be driven by auger 160 or ejected by the impeller. Auger housing 150 further includes a forwardly-directed auger housing opening 152 into which snow (and other material) enters augers housing 150 and an output located central and rearwardly of auger housing 150.

As utilized herein, relative terms or terms of degree such as approximately, substantially or like relative terms such as about, roughly and so forth, are intended to incorporate ranges and variations about a qualified term reasonably encountered by one of ordinary skill in the art in fabricating, compiling or optimizing the embodiments disclosed herein to suit design preferences, where not explicitly specified otherwise. For instance, a relative term can refer to ranges of manufacturing tolerances associated with suitable manufacturing equipment (e.g., injection molding equipment, extrusion equipment, metal stamping equipment, and so forth) for realizing a mechanical structure from a disclosed illustration or description. In some embodiments, depending on context and the capabilities of one of ordinary skill in the art, relative terminology can refer to a variation in a disclosed value or characteristic; e.g., a 0 to five-percent variance or a zero to ten-percent variance from precise mathematically defined value or characteristic, or any suitable value or range there between can define a scope for a disclosed term of degree. As an example, snow thrower apparatus 100 can eject snow from an impeller housing a disclosed distance, or substantially the disclosed distance: such as the disclosed distance with a variance of 0 to five-percent or 0 to ten-percent; a disclosed mechanical dimension can have a variance of suitable manufacturing tolerances as would be understood by one of ordinary skill in the art, or a variance of a few percent about the disclosed mechanical dimension that would also achieve a stated purpose or function of the disclosed mechanical dimension. These or similar variances can be applicable to other contexts in which a term of degree is utilized herein such as power consumption of a motor, speed of a disclosed motor in rotations per minute (or other suitable metric), accuracy of measurement of a physical effect (e.g., a snow throw distance, a relative torque output, a relative electric power consumption, a relative motor speed, etc.) or the like.

FIG. 2 illustrates a top perspective view of a second example snow thrower 200 showing controls 220 comprising left and right chute controls 222 and 224, according to various aspects discussed herein. Referring to FIG. 3, illustrated is a front side perspective view of snow thrower 200 showing controls 220 comprising left and right chute controls 222 and 224, according to various aspects discussed herein. Referring to FIG. 4, illustrated is a top view of snow thrower 200 showing controls 220 comprising left and right chute controls 222 and 224, according to various aspects discussed herein.

Example snow thrower 200 can be similar to example snow thrower 100 (or other types of snow throwers, e.g., single stage, one and a half stage, two stage, three stage, etc.), but example snow thrower 200 can additionally include a chute rotation control system as described herein (e.g., chute rotation control system 300, etc.), which can also be employed on any of a variety of snow throwers.

Snow thrower 200 has a single handle 210 with gripping locations for two operator hands. Operator controls 220 comprise a left (or counterclockwise) chute control 222, right (or clockwise) chute control 224, bail 226, display panel 227, power button 228, and mode control button 229. Snow thrower 200 can be powered on by pulling bail 226 toward handle 210 and depressing power button 228, and can be powered off by releasing bail 226 and/or depressing power button 228. When powered on, the auger, impeller, and/or movement elements of snow thrower 200 can be powered (e.g., by one or more internal batteries (not shown), although other embodiments can employ other power sources, etc.) and can operate in a manner similar to snow thrower 100. During operation, an operator's hands can be in an operating position that holds bail 226 to handle 210, allowing the operator to push and/or steer snow thrower 200.

Controls 220 comprise left and right chute controls 222 and 224 that can be actuated while an operator's hands are in the operating position. Left chute control 222 is a paddle that an operator can depress to actuate a chute rotation motor (not shown in FIGS. 2-4, but seen in FIGS. 5-6) to rotate chute 240 leftward (e.g., counterclockwise), and right chute control 224 is a paddle that an operator can depress to actuate the chute rotation motor to rotate chute 240 rightward (e.g., clockwise). Both left and right chute controls 222 and 224 can be depressed by an operator without moving either hand from an operating position wherein handle 210 and bail 226 are held together in order to push and/or steer snow thrower 200.

Display panel 227 can display one or more characteristics of snow thrower 200. The characteristics shown comprise individual battery levels for each of two batteries for snow thrower 200 and a mode indicator that indicates whether a current operating mode is a normal mode or a boost mode (e.g., which can provide increased torque at the auger in exchange for greater power consumption, etc.). Mode control button 229 can be depressed by an operator to switch between normal mode and boost mode.

Figure 5:
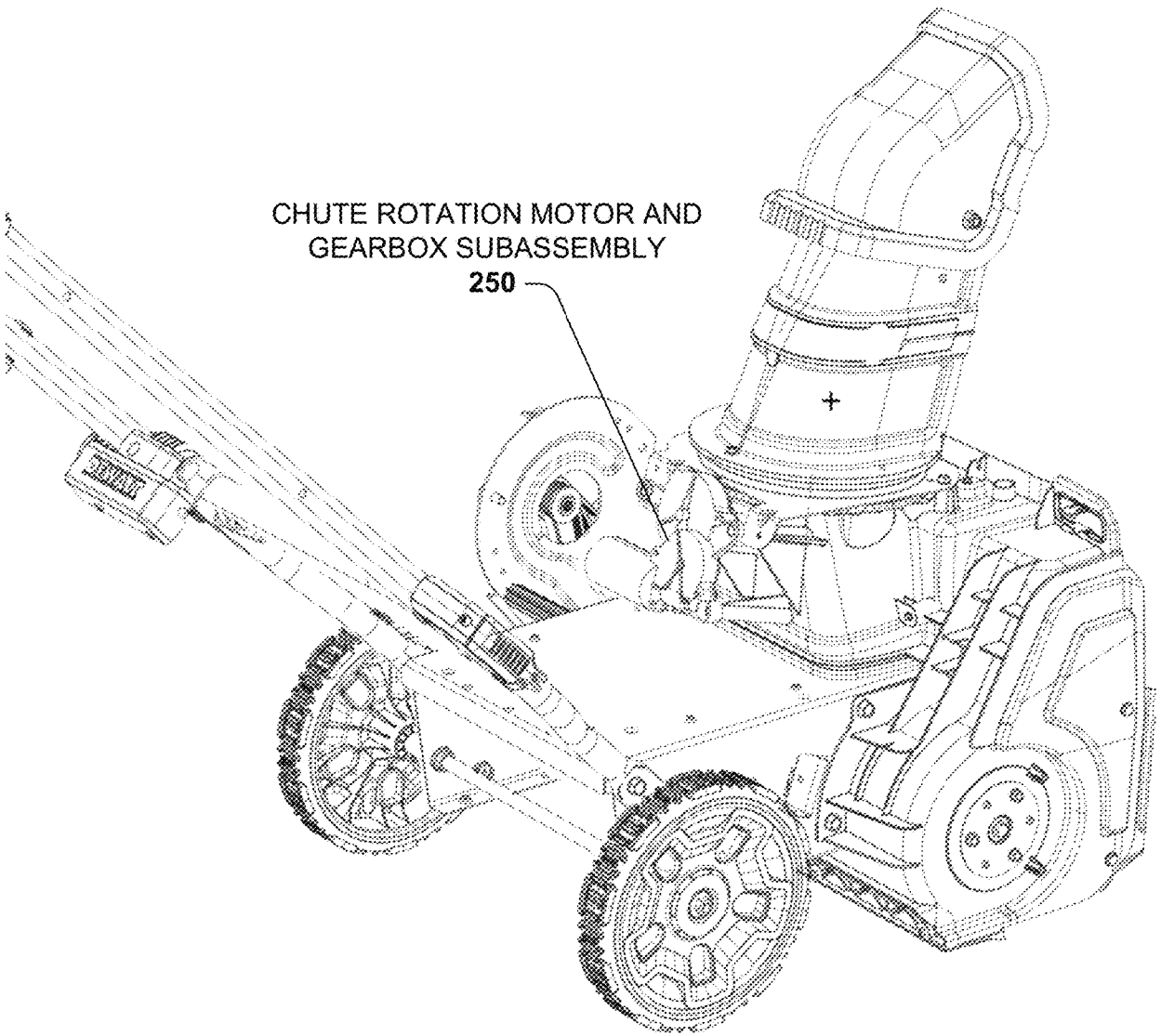
FIG. 5 illustrates a cutaway perspective view of the second example snow thrower showing a chute rotation motor and gearbox subassembly that can be used to rotate the chute based on operator inputs via chute controls, according to various aspects discussed herein.
Figure 6:
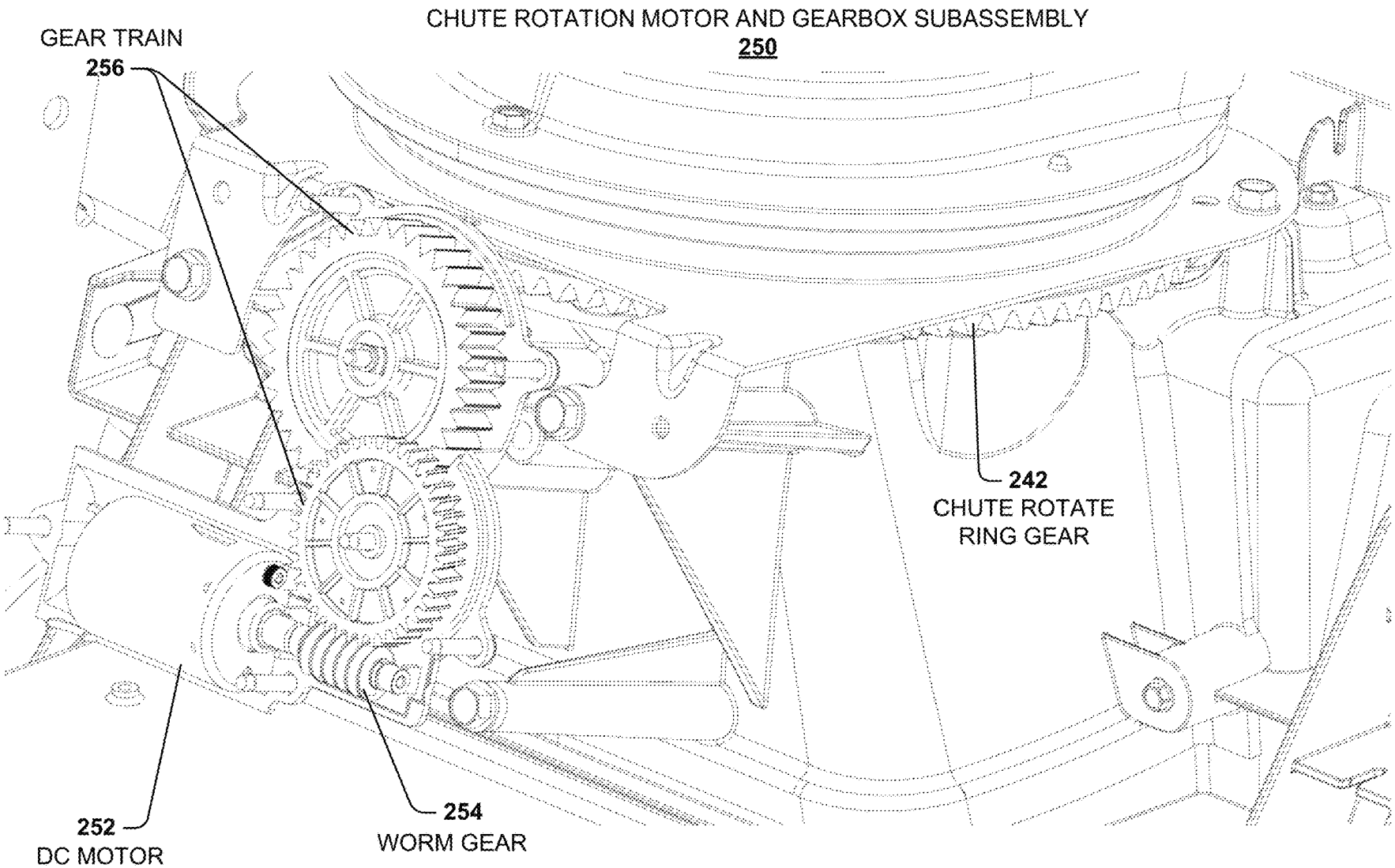
FIG. 6 illustrates components of the chute rotation motor and gearbox subassembly that can be used to rotate the chute, according to various aspects discussed herein.

Referring to FIG. 5, illustrated is a cutaway perspective view of snow thrower 200 showing a chute rotation motor and gearbox subassembly 250 that can be used to rotate chute 240 based on operator inputs via chute controls 222 and 224, according to various aspects discussed herein. Referring to FIG. 6, illustrated are components of the chute rotation motor and gearbox subassembly 250 that can be used to rotate chute 240, according to various aspects discussed herein. As can be seen in FIG. 6, subassembly 250 can comprise a DC motor 252 that can rotate worm 254, which can cause rotation of gear train 256, in turn rotating chute 240 via chute rotation ring gear 242. Other embodiments can employ other gearing (e.g., bevel, hypoid, etc.) to couple a motor shaft to a gear train when the axes of rotation of the motor shaft and coupled gear(s) are not parallel (e.g., when they are perpendicular, as in FIGS. 5-6, etc.). Still further embodiments can employ a motor shaft with a parallel axis to coupled gear(s) of the gear train and can drive the gear train via a spur gear, etc. rotating with the motor shaft. Similar non-geared embodiments (e.g., employing belt(s), chain(s), etc.) are also within the scope of the disclosure.

Figure 7:
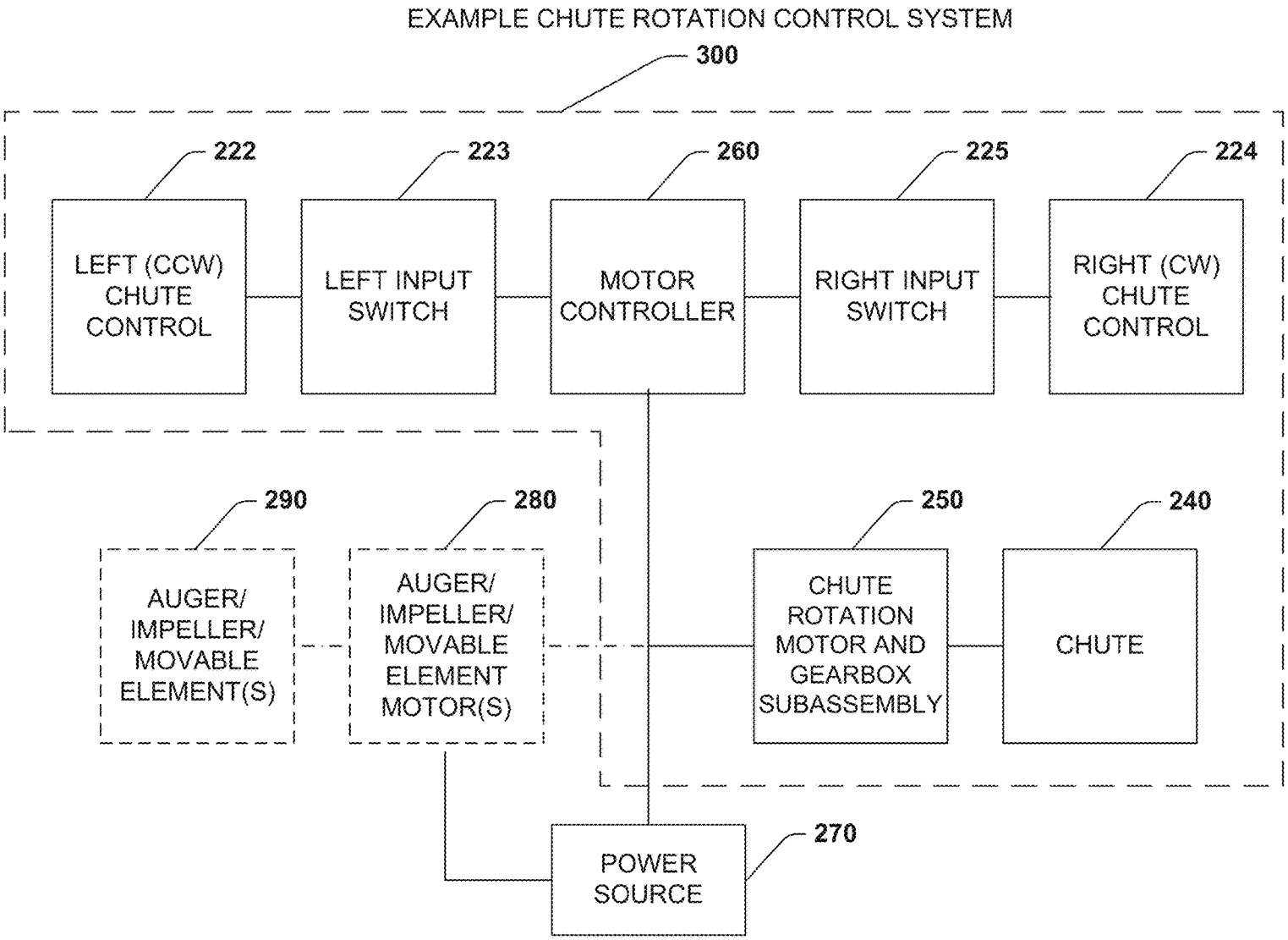
FIG. 7 illustrates a diagram of an example chute rotation control system that can be employed in a snow thrower, according to various aspects discussed herein.

Referring to FIG. 7, illustrated is a diagram of an example chute rotation control system 300 that can be employed in a snow thrower (e.g., snow thrower 100, 200, etc.), according to various aspects discussed herein. System 300 can comprise left and right chute controls 222 and 224, left and right input switches 223 and 225, chute 240, subassembly 250, and motor controller 260. A power source 270 (e.g., one or more batteries, outlet power, an internal combustion engine, a magneto of an engine, etc.) can power motor controller 260 and motor 252 in subassembly 270, as well as one or more motors 280 to drive the auger and impeller (and optionally the movement elements) 290. In some embodiments, motor controller 260 can be a dedicated motor controller solely for DC motor 252, while in other embodiments motor controller 260 can additionally control one or more other motors (e.g., motor(s) 280, etc.). In example embodiment 200, motor controller 260 is mounted to the underside of the frame of snow thrower 200, but in various other embodiments, motor controller 260 can be located at any of a variety of positions.

When a user presses either left chute control 222 or right chute control 224, the corresponding switch 223 or 225 can be closed, sending a corresponding signal to motor controller 260 (e.g., via wired or wireless connection, etc.). Based on which signal (e.g., via the left switch 223 or right switch 225, etc.) is received by motor controller 260 (or in various embodiments, which signal is received first in scenarios in which both switches 223 and 225 are closed, etc.), motor controller 260 can control DC motor 252 in subassembly 250 to rotate in a corresponding direction to turn chute 240 (e.g., left/counterclockwise or right/clockwise, respectively). DC motor 252 can drive gear train 256 via worm 254, thereby turning chute 240, which is coupled to gear train 256 via ring gear 242. In some embodiments, motor controller 260 can control DC motor 252 to rotate chute 240 to one or more specific angles based on commands received from the chute controls 222 and 224 via switches 223 and 225, respectively. For example, in some embodiments, in response to a double press (e.g., two consecutive presses within a threshold time of one another, etc.) on left or right chute control 222 or 224, motor controller 260 can cause DC motor 252 to rotate chute 240 to a maximum left angular position or a maximum right angular position, respectively. In some embodiments, one or more preset angular positions (e.g., a neutral angular position directing the chute straight forward, etc.) can be predefined. Additionally or alternatively, a user can define preset angular position(s) and/or instruct motor controller 260 to cause DC motor 252 to rotate chute 240 to preset angular position(s) via left and/or right inputs 222 and 224 (e.g., via multiple presses, simultaneous presses, multiple simultaneous presses, sequences of presses and/or simultaneous presses, etc.).

In example embodiment snow thrower 200, DC motor 252 can be a 12V motor and power source 270 can be 60V from internal batteries, and motor controller 260 can convert the 60V from power source 270 to the 12V for motor 252. In other embodiments, different voltages can be employed for motor 252 and/or power source 270, and voltage conversion can be performed by the same or other components (or may be unnecessary depending on the voltages). For the example embodiment, motor 252 will use approximately 50 W of power when operating and will not noticeable impact performance of the snow thrower 200 (e.g., in terms of torque on the auger/impeller, etc.). The example embodiment of subassembly 252 has a gear ratio of 444:1 from the shaft of motor 252 to the ring gear 242 of chute 240, with two example embodiments having gear ratios of 131:1 or 103:1 for gear train 256, although various embodiments can employ different gear ratios (e.g., more than 444:1 such as up to 500:1, between 444:1 and 103:1, less than 103:1 such as down to 50:1), which can also depend on the motor used (e.g., motor rotation speed, etc.). The example embodiment applies approximately 50 lb-ft of torque to rotate chute 240 and can rotate through 180° (the approximate angular range of chute 240 in some embodiments) in around 2.5 seconds with no drag, although ice and snow accumulation can provide drag that can slow rotation in various scenarios (e.g., to 3-10 seconds for 180° rotation, etc.), depending on the applied torque (e.g., 25-75 lb-ft, 35-65 lb-ft, etc.) and amount/nature of accumulation.

Figure 8:
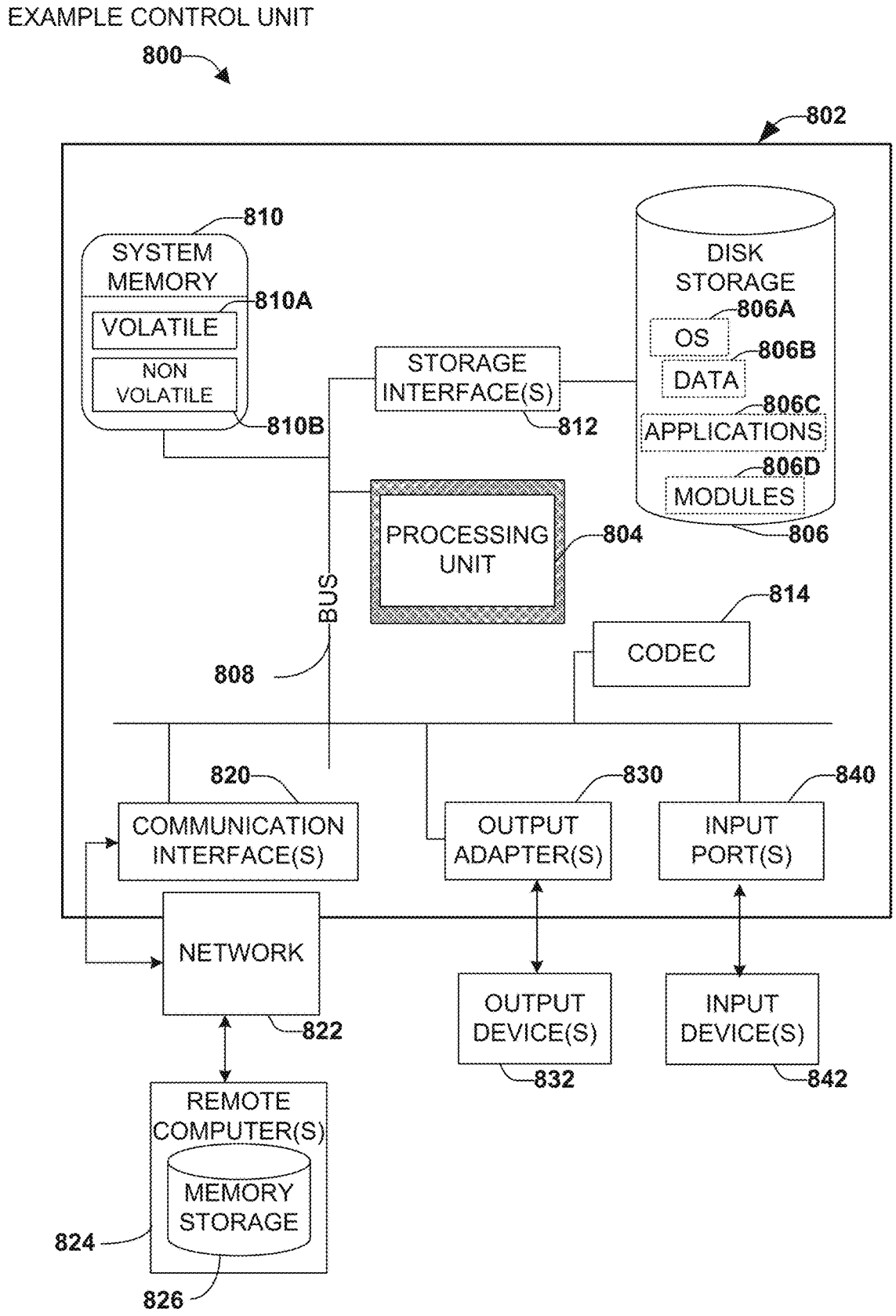
FIG. 8 illustrates a block diagram of an example control unit operable in conjunction with one or more aspects of the present disclosure.

In connection with FIG. 8, the systems and processes described herein can be embodied within hardware, such as a single integrated circuit (IC) chip, multiple ICs, an application specific integrated circuit (ASIC), or the like. A suitable control unit 800 for implementing various aspects of the claimed subject matter includes a computer 802. In various embodiments, a control unit (e.g., control unit 1390, etc.) of a snow thrower can be embodied in part by computer 802, or an analogous computing device known in the art, subsequently developed, or made known to one of ordinary skill in the art by way of the context provided herein.

The computer 802 can include a processing unit 804, a system memory 810, a codec 814, and a system bus 808. The system bus 808 couples system components including, but not limited to, the system memory 810 to the processing unit 804. The processing unit 804 can be any of various available processors. Dual microprocessors and other multiprocessor architectures also can be employed as the processing unit 804.

The system bus 808 can be any of several types of bus structure(s) including the memory bus or memory controller, a peripheral bus or external bus, or a local bus using any variety of available bus architectures including, but not limited to, Controller Area Network (CAN), Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1394), and Small Computer Systems Interface (SCSI).

The system memory 810 can include volatile memory 810A, non-volatile memory 810B, or both. Operating instructions of a control unit (among other control units: 1390, etc., depicted herein) described in the present specification can be loaded into system memory 810, in various embodiments, upon startup of computer 802. The basic input/output system (BIOS), containing the basic routines to transfer information between elements within the computer 802, such as during start-up, is stored in non-volatile memory 810B. In addition, according to present innovations, codec 814 may include at least one of an encoder or decoder, wherein the at least one of the encoder or decoder may consist of hardware, software, or a combination of hardware and software. Although, codec 814 is depicted as a separate component, codec 814 may be contained within non-volatile memory 810B. By way of illustration, and not limitation, non-volatile memory 810B can include read only memory (ROM), programmable ROM (PROM), electrically programmable ROM (EPROM), electrically erasable programmable ROM (EEPROM), or Flash memory. Non-volatile memory 810B can be embedded memory (e.g., physically integrated with computer 802 or a mainboard thereof), or removable memory. Examples of suitable removable memory can include a secure digital (SD) card, a compact Flash (CF) card, a universal serial bus (USB) memory stick, or the like. Volatile memory 810A includes random access memory (RAM), which can serve as operational system memory for applications executed by processing unit 804. By way of illustration and not limitation, RAM is available in many forms such as static RAM (SRAM), dynamic RAM (DRAM), synchronous DRAM (SDRAM), double data rate SDRAM (DDR SDRAM), and enhanced SDRAM (ESDRAM), and so forth.

Computer 802 may also include removable/non-removable, volatile/non-volatile computer storage medium. FIG. 8 illustrates, for example, disk storage 806. Disk storage 806 includes, but is not limited to, devices such as a magnetic disk drive, solid state disk (SSD) floppy disk drive, tape drive, Flash memory card, memory stick, or the like. In addition, disk storage 806 can include storage medium separately or in combination with other storage medium including, but not limited to, an optical disk drive such as a compact disk ROM device (CD-ROM) or derivative technology (e.g., CD-R Drive, CD-RW Drive, DVD-ROM, and so forth). To facilitate connection of the disk storage 806 to the system bus 808, a removable or non-removable interface is typically used, such as interface 812. In one or more embodiments, disk storage 806 can be limited to solid state non-volatile storage memory, providing motion and vibration resistance for a control unit (e.g., motor controller 260 or a controller comprising motor controller 260, among others) operable in conjunction with a snow thrower (e.g., snow thrower 10, etc.).

It is to be appreciated that FIG. 8 describes software stored at non-volatile computer storage media (e.g., disk storage 806) utilized to operate a disclosed control unit 800 to manage power between two or more of an auger, impeller, or drive element(s) of a disclosed snow thrower (e.g., snow thrower 100 or 200 disclosed hereinabove). Such software includes an operating system 806A. Operating system 806A, which can be stored on disk storage 806, acts to control and allocate resources of the computer 802. Applications 806C take advantage of the management of resources by operating system 806A through program modules 806D, and program data 806B, such as the boot/shutdown transaction table and the like, stored either in system memory 810 or on disk storage 806. It is to be appreciated that the claimed subject matter can be implemented with various operating systems or combinations of operating systems.

Input device(s) 842 connects to the processing unit 804 and facilitates user interaction with control unit 800 through the system bus 808 via interface port(s) 830. Input port(s) 840 can include, for example, a serial port, a parallel port, a game port, a universal serial bus (USB), among others. Output device(s) 832 use some of the same type of ports as input device(s) 842. Thus, for example, a USB port may be used to provide input to computer 802 and to output information from computer 802 to an output device 832. Output adapter 830 is provided to illustrate that there are some output devices, such as graphic display, speakers, and printers, among other output devices, which require special adapters. The output adapter 830 can include, by way of illustration and not limitation, video and sound cards that provide a means of connection between the output device 832 and the system bus 808. It should be noted that other devices or systems of devices provide both input and output capabilities such as remote computer(s) 824 and memory storage 826.

Computer 802 can operate in conjunction with one or more electronic devices described herein. For instance, computer 802 can facilitate power management between two or more of an auger, impeller, or drive element(s), within a power management system 1300 of a disclosed snow thrower apparatus, as described herein. Additionally, computer 802 can communicatively couple with auger motor controller 1322, impeller motor controller 1342, or drive motor controller(s) 1362 to manage power for auger(s) 1310, impeller 1330, or drive element(s) 1350, respectively, according to one or more aspects discussed herein.

Communication connection(s) 820 refers to the hardware/software employed to connect the network interface 822 to the system bus 808. While communication connection 820 is shown for illustrative clarity inside computer 802, it can also be external to computer 802. The hardware/software necessary for connection to the network interface 822 includes, for exemplary purposes only, internal and external technologies such as, modems including regular telephone grade modems, cable modems and DSL modems, ISDN adapters, and wired and wireless Ethernet cards, hubs, and routers.

In regard to the various functions performed by the above described components, machines, devices, processes and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the embodiments. In this regard, it will also be recognized that the embodiments include a system as well as electronic hardware configured to implement the functions, or a computer-readable medium having computer-executable instructions for performing the acts or events of the various processes.

In addition, while a particular feature may have been disclosed with respect to only one of several implementations, such feature may be combined with one or more other features of the other implementations as may be desired and advantageous for any given or particular application. Furthermore, to the extent that the terms "includes," and "including" and variants thereof are used in either the detailed description or the claims, these terms are intended to be inclusive in a manner similar to the term "comprising."

As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

In other embodiments, combinations or sub-combinations of the above disclosed embodiments can be advantageously made. The block diagrams of the architecture and flow charts are grouped for ease of understanding. However, it should be understood that combinations of blocks, additions of new blocks, re-arrangement of blocks, and the like are contemplated in alternative embodiments of the present disclosure.

The following examples pertain to further embodiments.

Example 1 is a chute rotation control system configured to rotate a chute of a snow thrower, comprising: a chute rotation motor coupled to the chute via one or more gears, wherein the chute rotation motor is configured to alternately rotate the chute clockwise and counterclockwise; a left chute control configured to receive one or more left user inputs and to generate a left output signal; a right chute control configured to receive one or more right user inputs and to generate a right output signal; and a motor controller configured to receive the left input signal and the right input signal, to cause the chute rotation motor to rotate the chute counterclockwise in response to the left input, and to cause the chute rotation motor to rotate the chute clockwise in response to the right input signal.

Example 2 comprises the subject matter of any variation of example(s) 1, wherein the left chute control is configured to receive the one or more left user inputs and the right chute control is configured to receive the one or more right user inputs from an operator while hands of the operator are in operating positions on the snow thrower.

Example 3 comprises the subject matter of any variation of example(s) 1-2, wherein the left chute control and the right chute control are paddles configured to be actuated via being pressed by an operator.

Example 4 comprises the subject matter of any variation of example(s) 1-3, wherein the motor is coupled to the gear train via a worm.

Example 5 comprises the subject matter of any variation of example(s) 1-4, wherein the gear train is coupled to the chute via a ring gear of the chute.

Example 6 comprises the subject matter of any variation of example(s) 1-5, wherein the left chute control is configured to generate the left output signal by closing a left switch in response to the one or more left user inputs, and wherein the right chute control is configured to generate the right output signal by closing a right switch in response to the one or more right user inputs.

Example 7 comprises the subject matter of any variation of example(s) 1-6: wherein, in response to receiving two separate left input signals within a threshold time, the motor controller is configured to cause the chute rotation motor to rotate the chute counterclockwise to a first predetermined position, and wherein, in response to receiving two separate right input signals within the threshold time, the motor controller is configured to cause the chute rotation motor to rotate the chute clockwise to a second predetermined position.

Example 8 comprises the subject matter of any variation of example(s) 7, wherein the first predetermined position is associated with a maximum counterclockwise rotation of the chute, and wherein the second predetermined position is associated with a maximum clockwise rotation of the chute.

Example 9 comprises the subject matter of any variation of example(s) 1-8, wherein, in response to the motor controller receiving the left input signal during a first period of time and receiving the right input signal during a second period of time that overlaps with the first period of time, the motor controller is configured to cause the chute rotation motor to rotate the chute counterclockwise in response to the first period of time beginning before the second period of time, and to cause the chute rotation motor to rotate the chute clockwise in response to the second period of time beginning before the first period of time.

Example 10 comprises the subject matter of any variation of example(s) 1-8, wherein, in response to the motor controller receiving the left input signal during a first period of time and receiving the right input signal during a second period of time that overlaps with the first period of time, the motor controller is configured to cause the chute rotation motor to rotate the chute to a neutral angular position.

Example 11 comprises the subject matter of any variation of example(s) 1-10, wherein the motor is configured to rotate the chute with a torque between 25 lb-ft and 75 lb-ft.

Example 12 comprises the subject matter of any variation of example(s) 1-11, wherein the motor is configured to rotate the chute through its range of rotation within 10 seconds or less.

Example 13 comprises the subject matter of any variation of example(s) 1-12, wherein the chute has a range of rotation of approximately 180 degrees.

Example 14 is a snow thrower, comprising: one or more movement elements configured to move the snow thrower on a surface; an auger housing and an auger positioned within the auger housing for moving material within the auger housing toward an output of the auger housing; an impeller housing coupled to the auger housing and having an intake through which the material is received at the impeller housing from the output of the auger housing; an impeller configured to receive the material at the intake of the impeller housing and expel the material from the impeller housing by way of a chute coupled to the impeller housing; a power system comprising an electric motor that generates mechanical power as an output and receives electrical power as an input; and a chute rotation control system configured to rotate the chute, comprising: a chute rotation motor coupled to the chute via one or more gears, wherein the chute rotation motor is configured to alternately rotate the chute clockwise and counterclockwise; a left chute control configured to receive one or more left user inputs and to generate a left output signal; a right chute control configured to receive one or more right user inputs and to generate a right output signal; and a motor controller configured to receive the left input signal and the right input signal, to cause the chute rotation motor to rotate the chute counterclockwise in response to the left input, and to cause the chute rotation motor to rotate the chute clockwise in response to the right input signal.

Example 15 comprises the subject matter of any variation of example(s) 14, wherein the motor controller is configured to control the electric motor in response to one or more additional user inputs.

Example 16 comprises the subject matter of any variation of example(s) 14-15, wherein the motor controller is a dedicated controller for the chute rotation motor.

Example 17 comprises the subject matter of any variation of example(s) 14-16, wherein the left chute control is configured to receive the one or more left user inputs and the right chute control is configured to receive the one or more right user inputs from an operator while hands of the operator are in operating positions on the snow thrower.

Example 18 comprises the subject matter of any variation of example(s) 14-17, wherein the left chute control and the right chute control are paddles configured to be actuated via being pressed by an operator.

Example 19 comprises the subject matter of any variation of example(s) 14-18, wherein the motor is coupled to the gear train via a worm.

Example 20 comprises the subject matter of any variation of example(s) 14-19, wherein the gear train is coupled to the chute via a ring gear of the chute.

Example 21 comprises the subject matter of any variation of example(s) 14-20, wherein the left chute control is configured to generate the left output signal by closing a left switch in response to the one or more left user inputs, and wherein the right chute control is configured to generate the right output signal by closing a right switch in response to the one or more right user inputs.

Example 22 comprises the subject matter of any variation of example(s) 14-21: wherein, in response to receiving two separate left input signals within a threshold time, the motor controller is configured to cause the chute rotation motor to rotate the chute counterclockwise to a first predetermined position, and wherein, in response to receiving two separate right input signals within the threshold time, the motor controller is configured to cause the chute rotation motor to rotate the chute clockwise to a second predetermined position.

Example 23 comprises the subject matter of any variation of example(s) 22, wherein the first predetermined position is associated with a maximum counterclockwise rotation of the chute, and wherein the second predetermined position is associated with a maximum clockwise rotation of the chute.

Example 24 comprises the subject matter of any variation of example(s) 14-23, wherein, in response to the motor controller receiving the left input signal during a first period of time and receiving the right input signal during a second period of time that overlaps with the first period of time, the motor controller is configured to cause the chute rotation motor to rotate the chute counterclockwise in response to the first period of time beginning before the second period of time, and to cause the chute rotation motor to rotate the chute clockwise in response to the second period of time beginning before the first period of time.

Example 25 comprises the subject matter of any variation of example(s) 14-23, wherein, in response to the motor controller receiving the left input signal during a first period of time and receiving the right input signal during a second period of time that overlaps with the first period of time, the motor controller is configured to cause the chute rotation motor to rotate the chute to a neutral angular position.

Example 26 comprises the subject matter of any variation of example(s) 14-25, wherein the motor is configured to rotate the chute with a torque between 25 lb-ft and 75 lb-ft.

Example 27 comprises the subject matter of any variation of example(s) 14-26, wherein the motor is configured to rotate the chute through its range of rotation within 10 seconds or less.

Example 28 comprises the subject matter of any variation of example(s) 14-27, wherein the chute has a range of rotation of approximately 180 degrees.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A chute rotation control system configured to rotate a chute of a snow thrower, comprising:

a chute rotation motor coupled to the chute via one or more gears, wherein the chute rotation motor is configured to alternately rotate the chute clockwise and counterclockwise;

a left chute control configured to receive one or more left user inputs and to generate a left output signal;

a right chute control configured to receive one or more right user inputs and to generate a right output signal; and a motor controller configured to receive the left input signal and the right input signal, to cause the chute rotation motor to rotate the chute counterclockwise in response to the left input, and to cause the chute rotation motor to rotate the chute clockwise in response to the right input signal; and wherein, in response to receiving two separate left input signals within a threshold time, the motor controller is configured to cause the chute rotation motor to rotate the chute counterclockwise to a first predetermined position, and wherein, in response to receiving two separate right input signals within the threshold time, the motor controller is configured to cause the chute rotation motor to rotate the chute clockwise to a second predetermined position.

2. The chute rotation control system of claim 1, wherein the left chute control is configured to receive the one or more left user inputs and the right chute control is configured to receive the one or more right user inputs from an operator while hands of the operator are in operating positions on the snow thrower.

3. The chute rotation control system of claim 1, wherein the left chute control and the right chute control are paddles configured to be actuated via being pressed by an operator.

4. The chute rotation control system of claim 1, wherein the motor is coupled to the gear train via a worm.

5. The chute rotation control system of claim 1, wherein the gear train is coupled to the chute via a ring gear of the chute.

6. The chute rotation control system of claim 1, wherein the left chute control is configured to generate the left output signal by closing a left switch in response to the one or more left user inputs, and wherein the right chute control is configured to generate the right output signal by closing a right switch in response to the one or more right user inputs.

7. The chute rotation control system of claim 1, wherein the first predetermined position is associated with a maximum counterclockwise rotation of the chute, and wherein the second predetermined position is associated with a maximum clockwise rotation of the chute.

8. The chute rotation control system of claim 1, wherein, in response to the motor controller receiving the left input signal during a first period of time and receiving the right input signal during a second period of time that overlaps with the first period of time, the motor controller is configured to cause the chute rotation motor to rotate the chute counterclockwise in response to the first period of time beginning before the second period of time, and to cause the chute rotation motor to rotate the chute clockwise in response to the second period of time beginning before the first period of time.

9. The chute rotation control system of claim 1, wherein, in response to the motor controller receiving the left input signal during a first period of time and receiving the right input signal during a second period of time that overlaps with the first period of time, the motor controller is configured to cause the chute rotation motor to rotate the chute to a neutral angular position.

10. The chute rotation control system of claim 1, wherein the motor is configured to rotate the chute with a torque between 25 lb-ft and 75 lb-ft.

11. The chute rotation control system of claim 1, wherein the motor is configured to rotate the chute through its range of rotation within 10 seconds or less.

12. The chute rotation control system of claim 1, wherein the chute has a range of rotation of approximately 180 degrees.

* * * * *